United States Patent [19]

Emory

[11] 4,154,056

[45] May 15, 1979

[54] FUEL NOZZLE ASSEMBLY FOR A GAS TURBINE ENGINE

[75] Inventor: John M. G. Emory, Middletown, Pa.

[73] Assignee: Westinghouse Electric Corp., Pittsburgh, Pa.

[21] Appl. No.: 830,965

[22] Filed: Sep. 6, 1977

[51] Int. Cl.[2] ..... F02C 7/22

[52] U.S. Cl. ..... 60/39.32; 60/39.74 R; 239/397.5; 239/424.5

[58] Field of Search ..... 60/39.74 R, 39.74 B, 60/39.32; 239/397.5, 424.5, 421, 406

[56] References Cited

U.S. PATENT DOCUMENTS

| | | | |
|---|---|---|---|
| 2,854,285 | 9/1958 | Barton | 60/39.74 R |
| 3,213,918 | 10/1965 | Rudzki et al. | 239/397.5 |
| 3,578,246 | 5/1971 | Davis | 239/424.5 |

FOREIGN PATENT DOCUMENTS

| | | |
|---|---|---|
| 1367204 | 0000 | United Kingdom. |
| 1229802 | 0000 | United Kingdom. |
| 486592 | 0000 | United Kingdom. |
| 1521584 | 0000 | United Kingdom. |

*Primary Examiner*—Robert E. Garrett
*Attorney, Agent, or Firm*—F. A. Winans

[57] ABSTRACT

A fuel nozzle assembly having a nozzle tip disposed in one end of a fuel delivery tube supported in a mounting flange. An air delivery tube, also secured to said support flange, encloses the fuel delivery tube to define an annular air chamber therebetween. The air delivery tube and the fuel delivery tube define interengaging tab portions providing a breech-lock engagement therebetween, with the tab members disposed closely adjacent the nozzle tip and effecting a sealing engagement between the nozzle tip and an aperture in the end of the air delivery tube through which the tip protrudes. To accommodate unequal axial expansion of the two tubes, the air delivery tube is mounted to the support flange with a flexible diaphragm. The axial closeness of the breech-lock to the sealing engagement at the nozzle minimizes the differential axial expansion between the two tubes over this axial extent and prevents air escaping from the air chamber at the sealing interface of the nozzle tip and the aperture in the air delivery tube.

7 Claims, 3 Drawing Figures

FUEL NOZZLE ASSEMBLY FOR A GAS TURBINE ENGINE

BACKGROUND OF THE INVENTION

1. Field of the Invention

This invention relates to a fuel nozzle assembly for a gas turbine engine, and more particularly to such an assembly having separate air and fuel delivery passages.

2. Description of the Prior Art

The prior art will be more fully described in detail in the following Description of the Preferred Invention; however, generally speaking, a fuel nozzle assembly capable of separately delivering both air and fuel to a combustion chamber comprises a fuel delivery tube supported from one end having a fuel nozzle tip secured to the other, and an air delivery tube, also supported at one end, and generally enclosing the fuel delivery tube in a spaced relationship to define therebetween an annular air flow channel. A cap is threaded onto the free end of the air delivery tube and tightened so that a frusto-conical opening in the face thereof sealingly engages the frusto-conical surface of the nozzle tip. However, the temperature of the fuel flowing through the fuel tube is generally on the order of about 100° F. whereas the temperature of the air in the space between the tubes is on the order of about 600° F. This causes a differential in the axial expansion of the two tubes resulting in a gap at the normally sealing interface of the air cap and the nozzle tip. This gap provides an area where contaminates from the air flowing therethrough or carbon deposits caused by occasional reverse flow from the combustor can accumulate to prevent the gap from resealing.

As the air delivered through the assembly is primarily used only at ignition of the gas turbine engine to atomize the fuel, it is important to provide an atomizing air pattern which is predictable and delivers an atomized fuel-air mixture generally adjacent to either a flame crossover tube or the spark ignitor, or both. However, any gap between the air tube and the fuel nozzle tip provides an air leakage path that deleteriously affects the atomizing air distribution such that an unpredictable fuel-air pattern can exist, which in turn can produce erratic and unpredictable light-off characteristics.

Further, once the fuel nozzle assembly of the known prior art is assembled and mounted in the combustor of a gas turbine engine, it becomes generally impossible to mechanically clean the air delivery channel and eliminate the deposits that cause the leakage, as will be evident from the detailed description of the prior art nozzle.

Reference is made to U.S. Pat. No. 3,763,650, having a common assignee with the present application, for showing the relative position of a fuel nozzle assembly in the combustor of the gas turbine engine, and the spatial relationship of the spark ignitor thereto.

SUMMARY OF THE INVENTION

The present invention provides a fuel delivery tube substantially enclosed by an air delivery tube. The respective tubes are locked together adjacent their common discharge end and thereby maintaining a sealing engagement between the air tube and the fuel nozzle tip extending therethrough. However, to accommodate axial differential expansion between the two tubes, the air delivery tube is supported at the opposite end from a support flange with a generally flexible diaphragm that deforms in accordance with the differential axial expansion. Further, the nozzle assembly of the present invention is simplified by reducing the parts and also permits the air tube passages to be cleaned after the assembly is mounted in a combustor of a gas turbine engine.

DESCRIPTION OF THE PREFERRED EMBODIMENT

Figure 1:
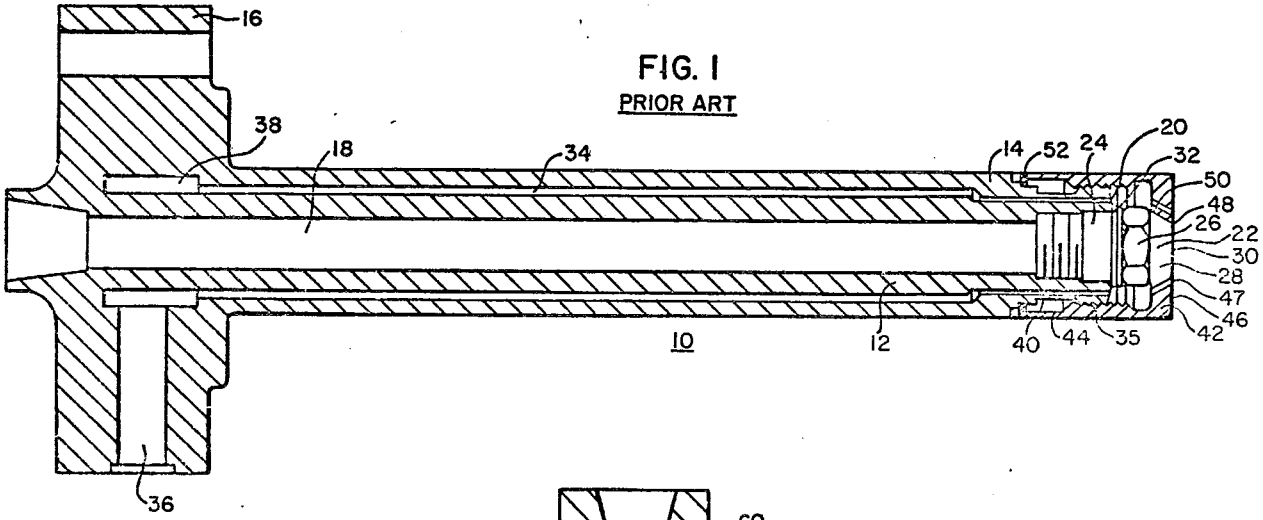
FIG. 1 PRIOR ART
FIG. 1 is an axial cross sectional view of a prior art fuel nozzle assembly.

Referring to FIG. 1, the nozzle assembly 10 of the prior art is seen to include a pair of concentric substantially coextensive tubular members 12, 14 extending axially from a support flange 16 at one end. The inner tubular member 12 is the fuel delivery tube and has an axial opening 18 therethrough which is internally threaded at each end thereof. A fuel line (not shown) is normally received in the flange end and the opposite end supports a fuel nozzle tip 22. The tip 22 includes a threaded skirt portion 24, a hexagonal flange 26, and a frusto-conical face 28 terminating in a planar discharge end 30. A sealing washer 32 is interposed between the hexagonal flange 26 and the end 20 of the fuel tube to provide a sealed engagement therebetween.

The outer tubular member 14 defines the air delivery tube and provides the annular air passage 34 between the outer wall of the fuel tube 12 and the inner wall of the air tube 14 throughout their common axial extent. The support flange 16 includes a threaded radially extending passage 36 for receipt of an air line (not shown) terminating in an annular cavity 38 in air flow communication with the passage 34. The opposite end 40 of the air tube 14 has a reduced outer diameter 35 threaded for receipt of an internally threaded end cap 42.

The end cap 42 includes an internally threaded skirt portion 44 extending axially from a planar end wall 46 which contains a centrally located opening 48 having a tapered circumferential surface 50 conforming to the taper of the frusto-conical nozzle tip so that as the end cap 42 is tightened onto the air tube 14, the nozzle tip projects into the opening and, when properly tightened, provides a sealed engagement between the mating frusto-conical surfaces 28, 50. The end cap 42 is retained in this assembled tightened position by a split washer 52 between the end cap skirt 44 and the facing portion of the air tube 14 by deforming the washer in a manner to engage notches in the respective facing parts so as to prevent relative rotation therebetween.

The planar end wall 46 of the end cap contains four small apertures 47 equiangularly spaced about the center of the end cap for directing atomizing air in a predetermined convergent direction to intercept and atomize the fuel exiting the tip 22.

As is known, the fuel nozzle tip 22 injects fuel in an outwardly diverging generally conical pattern. However, during that low fuel flow rate portion of the cycle, i.e. light-off, fuel pressure atomization is poor and the air is introduced through the end cap to further atomize the fuel injected by the nozzle; the conical pattern thus is altered somewhat, resulting in a nodular or four-spoked spray pattern. This additional atomizing air is necessary during light-off or ignition to provide greater atomization of the fuel as introduced through the nozzle tip to reduce unburned fuel emissions and to obtain better distribution of the air fuel mixture to insure that it is delivered to adjacent the spark ignitor (see the earlier referenced patent for the location of the spark ignitor in a combustor) and to adjacent the flame cross-over tubes of each combustor to propagate the combustion process to all the combustors in the turbine. Afterwards, the atomization air is normally cut off, and fuel only is delivered through the nozzle tip to continue the combustion process.

During normal engine operation, combustion air from the compressor surrounds the air delivery tube 14 and has a temperature of approximately 600° to 700° F. The fuel, however, generally has a temperature of about 100° F. thereby exposing the fuel delivery tube 12 to a much lower temperature than that of the air delivery tube 14. This causes the air delivery tube to expand axially greater than the fuel tube and, over the axial extent of the two tubes, results in a gap (on the order of 0.030 inches) between the frusto-conical tip 28 and the opening 50 in the gap 42 of the air tube 14. Further, because of contaminants in the air or occasional reverse flow of combustion products into this gap particles build up or become lodged in this gap which prevents resealing engagement prior to subsequent ignition. The air leakage through this gap deleteriously alters the discharge of the atomization air, changing the atomization spray pattern and thus the light-off response of the combustor. Also, because of the relationship of the respective components of the assembly, the resultant gap and the normal air discharge ports in the cap are extremely difficult to clean without removal of the nozzle assembly from the combustor.

Figure 2:
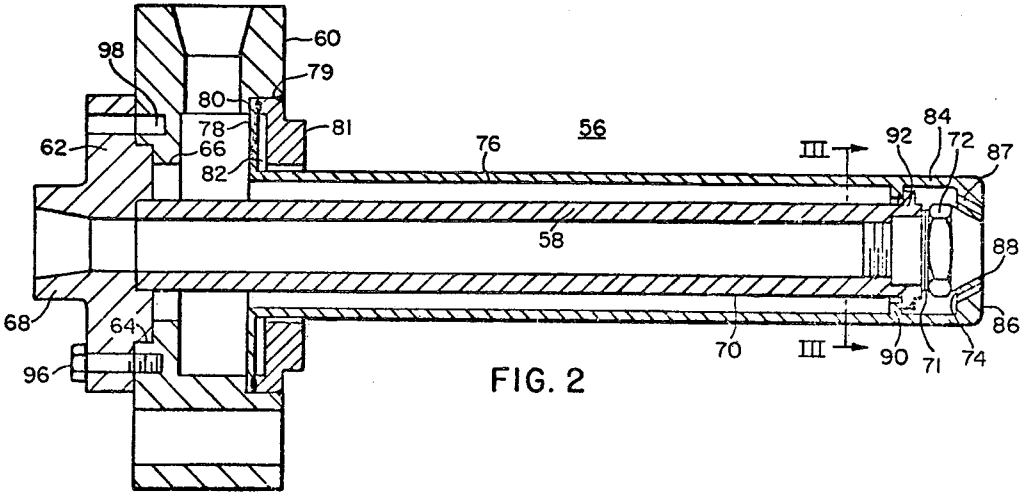
FIG. 2 is a view similar to FIG. 1 of the nozzle assembly of the present invention.

FIG. 2 shows the nozzle assembly 56 of the present invention. As therein seen, the inner fuel delivery tube 58 is separate from the support flange 60 and includes an inlet fitting 62, welded to the inlet end, having an enlarged stepped collar 64 facing the flange for locating and seating the fuel tube in an axial opening 66 through the flange. The inlet end 68 of the fitting 62 is hexagonal for the purpose of receiving a wrench for rotating the tube 58 as will be explained. The discharge end 70 of the tube 58 is internally threaded for receiving a nozzle tip 72 similar to the previously described tip 22 having a frusto-conical surface 72. A sealing washer 71 is interposed between the nozzle tip 72 and the end 70 of the fuel tube to provide a sealing engagement.

The outer tubular member 76 of the present assembly is the air delivery tube and extends axially from a relatively thin annular diaphragm member 78 radially extending between the tube 76 and a countersunk locating surface 80 on the face of the support flange 60. The diaphragm 78 is retained in the assembled position by an outer axially projecting lip 79 of an annular support ring 81 also disposed within the countersunk surface, with the lip 79 welded to the outer area of the diaphragm 78 to provide an annular slot 82 between the ring 81 and the diaphragm 78. The ring 81 is in turn welded to the face of the support flange 60.

The opposite end 84 of the air tube provides a planar wall 86 containing a frusto-conical axial opening 88 through which the nozzle tip 72 extends and, when in assembled position, provides a sealing engagement with the frusto-conical portion 74 of the tip. The wall 86 also includes appropriate air discharge openings 87 for the atomization of the fuel during light-off.

Figure 3:
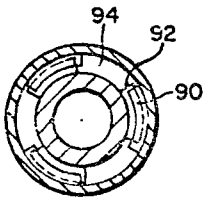
FIG. 3 is a cross sectional view along lines III—III of FIG. 2.

The outer or discharge end 70 of the fuel tube 58 and the adjacent portion of the air tube have, as seen in FIGS. 2 and 3, a plurality of interengaging lugs 90, 92 having facing camming surfaces to provide a breech-lock engagement therebetween such that relative rotation between the tubes in a given direction will cam the fuel tube outwardly and thereby force the nozzle tip 72 into a sealing engagement by the frusto-conical opening 88 in the outer wall whereas opposite rotation will align the respective lugs 92 with gaps 94 therebetween for withdrawal of the inner fuel tube 58 from the air tube 76.

As seen from this assembly of the present invention according to FIGS. 2 and 3, the air tube 76 is maintained rotationally stationary with respect to the support flange 60 and has an integral end cap portion 84 providing air discharge openings 87 and a tip sealing opening 88. However, the fuel tube 58 is manually rotatable with respect to the support flange 60 and outer air tube 76 and is held in the final assembled position by bolts 96 received through arcuate elongated slots in the stepped collar 64 (to permit variations in the final assembly tightness or position) and threaded into tapped holes 98 in the support flange 60.

Thus, in the assembly of the present invention, the breech-lock interengagement between the two tubes 58, 76 substantially adjacent the nozzle tip limits the axial expansion that would produce a gap between the nozzle tip 72 and the adjacent face 88 of the air tube, to only that axial portion between the breech-lock and the front face 86. As this axial dimension is quite small, there will not be sufficient expansion provided to produce a gap between the frusto-conical surface 74 of the nozzle tip and the opening 88 in this face. All other relative expansion between the two tubes will be accommodated by deformation (i.e. to either the right or left as viewed in FIG. 2) of the diaphragm 78 in the axial direction.

Further, it is readily apparent that the assembly of the present invention as shown in FIG. 2 has fewer separate parts than the prior art assembly of FIG. 1, and provides a removable fuel tube to expose the air tube for easy mechanical cleaning.

As a further benefit, in that the air tube 76 is stationarily located, it permits a predetermined definite orientation of the air atomization ports 87 to determine the ultimate location of the nodules or spokes of the fuel pattern during light-off so that such spoked arrangement can be located to best accomplish light-off and flame propagation through the cross-over tubes.

I claim:

1. A fuel nozzle assembly for a gas turbine engine comprising:

a fuel delivery tube having a fuel nozzle at one end and fuel inlet means at the opposite end;

a support flange attached to said fuel delivery tube generally adjacent said inlet means for mounting said fuel delivery tube in said engine;

an air delivery tube enclosing the portion of said fuel delivery tube extending from said support flange in spaced relation to define an annular air chamber therebetween, said air delivery tube terminating at one end in a wall defining an opening for receiving therein said nozzle of the fuel tube, and further defining a plurality of apertures through said wall and in communication with said air chamber for atomizing air passages;

and axially flexible means for attaching the opposite end of said air delivery tube to said support flange; and said fuel delivery tube and said air delivery tube define cooperatively engaging members generally adjacent their one end so that when said engagement is effected said nozzle is seated in said opening in a substantially sealed engagement therebetween and wherein, said flexible means mounting said air delivery tube to said support flange accommodates, through axial deflection, variations in the axial expansion of said two tubes.

2. The fuel nozzle assembly of claim 1 wherein said engaging members comprise a plurality of tab members extending from the facing surfaces of said respective tubes and having engaging camming surfaces whereby relative rotation of the tubes in one direction forces the nozzle into sealing engagement within the opening in said air delivery tube.

3. A fuel assembly of claim 1 wherein said axially flexible mounting means comprises a generally thin-walled ring member, having an outer periphery securely attached to said support flange and an inner periphery attached to said air delivery tube wherein axial dimensional changes of said air delivery tube cause said ring to deflect axially.

4. Structure according to claim 3 wherein said air delivery tube including said wall comprises a unitary member whereby the desired orientation of said apertures in said wall as mounted in said gas turbine engine can be maintained.

5. Structure according to claim 1 wherein said fuel inlet means on said fuel delivery tube comprises a collar member attached to said opposite end of said fuel delivery tube and having an opening therethrough in communication with said tube and wherein said collar member is disposed in a counter-sunk area on one face of said support flange to axially locate said tube with respect to said flange.

6. Structure according to claim 5 wherein said air delivery tube is stationarily mounted with respect to rotation to said support flange and said fuel delivery tube is removably supported on said support flange;

and wherein said engagement between said air delivery tube and said fuel delivery tube is effected by rotation of said fuel tube relative to said stationary flange and air tube and whereby reverse rotation permits withdrawal of said fuel tube for ready access to said air tube.

7. A fuel nozzle assembly for a gas turbine engine comprising:

a fuel nozzle tip having a frusto-conical surface and a threaded skirt portion;

an elongated fuel delivery tube having one end engaging the nozzle tip and the opposite end defining an enlarged collar member;

a support flange having an axial opening therethrough and means on one face for mounting the collar member;

an air delivery tube encircling said fuel delivery tube in spaced relation to define an annular air passage therebetween, said air delivery tube terminating at one end in a wall defining a frusto-conical opening for sealing engagement with the frusto-conical surface of the nozzle tip, said wall defining apertures therethrough for atomizing air exit ports, and means for mounting the opposite end of said delivery tube to said support flange;

said fuel delivery tube and said air delivery tube defining tab members providing a breech-lock engagement therebetween with said members disposed adjacent the end of said fuel delivery tube mounting said nozzle tip, and wherein said nozzle is seated in said frusto-conical opening in a substantially sealed relationship when said breech-lock engagement is completed; and further, wherein said means for mounting said air delivery tube to said support flange is generally axially flexible to accommodate, through deflection, variations in the axial expansion of said two tubes due to any differential in temperatures to which they are exposed and permitting the continuous sealed engagement between said frusto-conical surfaces and opening.

* * * * *